US011054104B2

(12) United States Patent
Mitterlehner et al.

(10) Patent No.: US 11,054,104 B2
(45) Date of Patent: Jul. 6, 2021

(54) MOTOR VEHICLE HEADLAMP

(71) Applicant: ZKW Group GmbH, Wieselburg (AT)

(72) Inventors: Stefan Mitterlehner, Mank (AT); Matthias Mayer, Mank (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 16/622,495

(22) PCT Filed: May 28, 2018

(86) PCT No.: PCT/AT2018/060107
§ 371 (c)(1),
(2) Date: Dec. 13, 2019

(87) PCT Pub. No.: WO2018/227221
PCT Pub. Date: Dec. 20, 2018

(65) Prior Publication Data

US 2020/0217473 A1 Jul. 9, 2020

(30) Foreign Application Priority Data

Jun. 14, 2017 (AT) ..... A 50497/2017

(51) Int. Cl.
*F21S 41/63* (2018.01)
*F21S 41/675* (2018.01)
(Continued)

(52) U.S. Cl.
CPC ..... *F21S 41/635* (2018.01); *F21S 41/25* (2018.01); *F21S 41/295* (2018.01); *F21S 41/36* (2018.01);
(Continued)

(58) Field of Classification Search
CPC ..... F21S 41/635; F21S 41/295; F21S 41/25; F21S 41/36; F21S 41/675; F21Y 2115/00; F21V 14/06; F21V 17/02
See application file for complete search history.

(56) References Cited

U.S. PATENT DOCUMENTS 1,502,684 A 7/1924 Arcy
4,857,794 A * 8/1989 Watanabe ..... F21S 41/635 313/113
(Continued)

FOREIGN PATENT DOCUMENTS

DE 102014213636 A 1/2015
JP H04184801 A 1/1992
WO 2016189907 A1 10/2018

OTHER PUBLICATIONS

Office Action for Austrian Application No. A 50497/2017, dated Feb. 27, 2018 (3 pages).
(Continued)

*Primary Examiner* — Alan B Cariaso
(74) *Attorney, Agent, or Firm* — Eversheds Sutherland (US) LLP

(57) ABSTRACT

The invention relates to a motor vehicle headlamp (101) comprising a light source (105), projection optics (102, 202) and a bracket (106, 206), wherein the light source (105) is mounted on the bracket (106, 206) and is configured to project light in the direction of a projection axis (104, 204) by means of the projection optics (102, 202), wherein the projection optics (102, 202) are mounted in a frame (103, 203) which is movably arranged in the bracket (106, 206). The headlamp further comprises a lever (107, 207) which is rotatably connected, by means of axis elements that form a pivot axis running transversely or normal to the projection axis (104, 204), to the bracket (106, 206). The frame (103, 203) comprises at least one lug (110, 210) which is located
(Continued)

Figure 1:
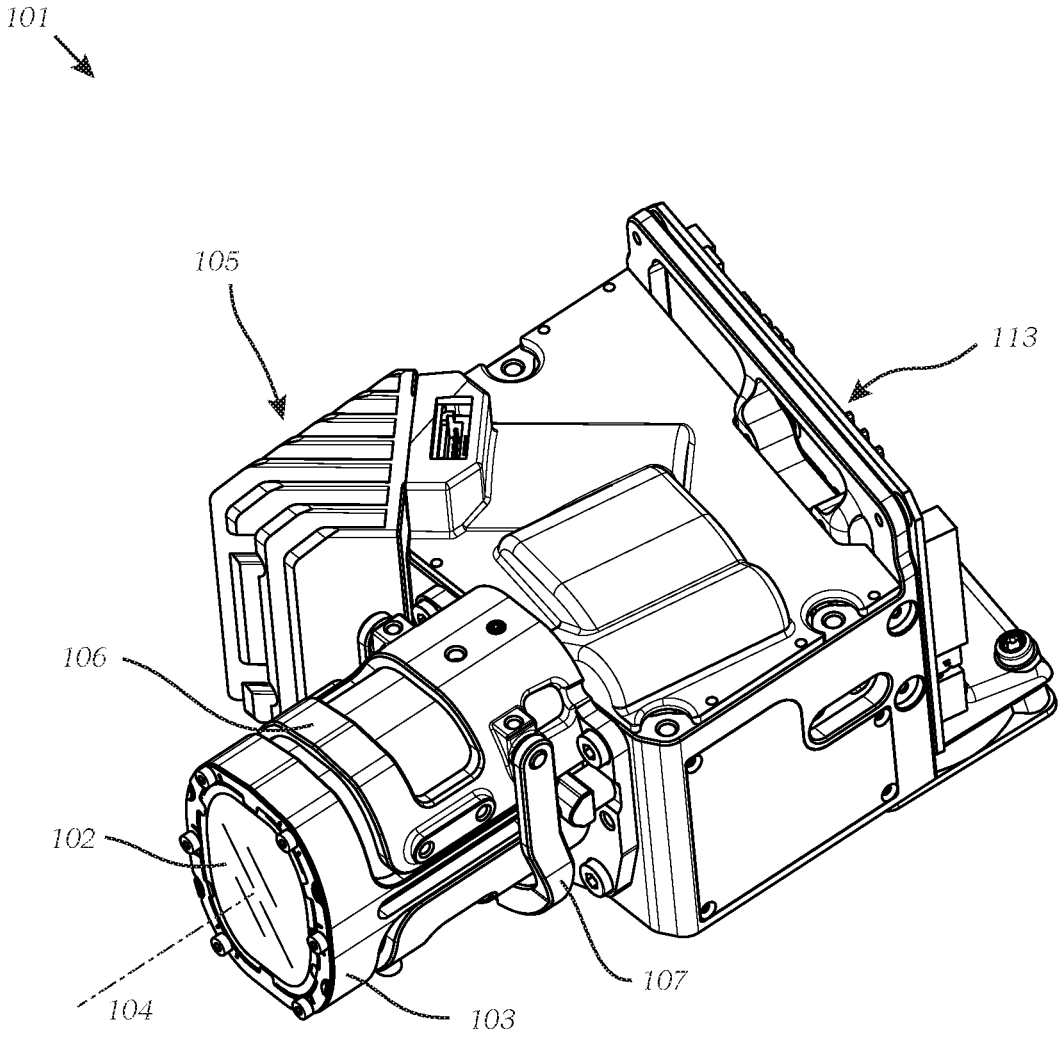

between the bracket (106, 206) and the lever (107, 207), and the lever (107, 207) is configured, in the event of a rotational motion around the pivot axis, to press on the at least one lug (110, 210), and thereby to displace the frame (103, 203) in the bracket (106, 206) along the projection axis (104, 204).

17 Claims, 11 Drawing Sheets

(51) Int. Cl.

| | |
|---|---|
| ***F21S 41/25*** | (2018.01) |
| ***F21S 41/29*** | (2018.01) |
| ***F21Y 115/00*** | (2016.01) |
| ***F21V 17/02*** | (2006.01) |
| ***F21V 14/06*** | (2006.01) |
| ***F21S 41/36*** | (2018.01) |

(52) U.S. Cl.
CPC ..... *F21S 41/675* (2018.01); *F21V 14/06* (2013.01); *F21V 17/02* (2013.01); *F21Y 2115/00* (2016.08)

(56) References Cited

U.S. PATENT DOCUMENTS

| | | | | |
|---|---|---|---|---|
| 6,186,651 | B1 | 2/2001 | Sayers et al. | |
| 2004/0202008 | A1 | 10/2004 | Goraguer | |
| 2016/0138783 | A1* | 5/2016 | Friedland | F21V 5/008 362/268 |
| 2018/0099605 | A1* | 4/2018 | Ahn | B60Q 1/076 |
| 2018/0118093 | A1* | 5/2018 | Yamazumi | F21S 41/635 |

OTHER PUBLICATIONS

International Search Report and Written Opinion for PCT/AT2018/060107, dated Oct. 4, 2018 (13 pages).

* cited by examiner

MOTOR VEHICLE HEADLAMP

The invention relates to a motor vehicle headlamp, comprising a light source, projection optics and a bracket, wherein the light source is connected with the bracket and configured to project light in the direction of a projection axis by means of the projection optics.

The invention further relates to a motor vehicle, which comprises at least one motor vehicle headlamp according to the invention.

During the development of current headlamp systems, the primary objective is increasingly to be able to project a homogeneous light image with the highest possible resolution onto the road. The term "road" is here used by way of a simplified description, since it of course also depends on the local conditions whether a light image is actually on the road or even extends over it. In principle, the light image in the meaning used corresponds to a projection onto a vertical surface according to the relevant standards relating to motor vehicle lighting technology.

In order to meet this requirement, among other things headlamps were developed in which a variably actuatable reflector surface consists of a plurality of micromirrors, and a light emission generated by a light source reflects in the direction of projection of the headlamp. Such lighting devices are advantageous in vehicle construction due to their very flexible light functions, since the illuminance can be individually controlled for different illuminated areas, and any desired light functions with various light distributions can be realized, for example a low beam light distribution, turning light distribution, city light distribution, highway light distribution, curve light distribution, high beam light distribution or the imaging of glare-free high beams.

The micromirror array is fabricated using the so-called digital light processing (DLP®) projection technology, in which images are generated by modulating a digital image onto a light beam. A rectangular array of movable micromirrors, also referred to as pixels, here breaks down the light beam into partial areas, and then projects it pixelwise either into the projection path or out of the projection path.

This technology is based upon an electronic component that contains the rectangular array in the form of a matrix of mirrors and their actuation technology, and is referred to as "digital micromirror device" (DMD).

A DMD microsystem involves a spatial light modulator (SLM), which consists of micromirror actuators arranged in a matrix, i.e., tiltable reflecting surfaces, for example with an edge length of about 16 μm. The mirror surfaces are here constructed in such a way that they can be moved through exposure to electrostatic fields. Each micromirror can be individually adjusted in terms of its angle, and as a rule has two stable end states, which can be switched between up to 5000 times a second. For example, the individual micromirrors can each be actuated via pulse-wide modulation (PWM), so as to image additional states of the micromirrors in the primary beam direction of the DMD array, whose time-averaged reflectivity lies between the two stable states of the DMD. The number of mirrors corresponds to the resolution of the projected image, wherein a mirror can display one or more pixels. DMD chips with high resolutions in the megapixel range have since become available. The technology underlying the adjustable individual mirrors is micro-electro-mechanical systems (MEMS) technology.

While DMD technology has two stable mirror states, and the reflection factor can be adjusted through modulation between the two stable states, a feature of "analog micromirror device" (AMD) technology is that the individual mirrors can be set in variable mirror positions, which are there each in a stable position.

For arrays using DLP® technology, it is important that the individual vehicle assemblies of a vehicle headlamp be mounted in a highly precise manner, meaning with very low tolerances that far exceed the requirements in conventional vehicle headlamps. The individual assemblies, for example light sources, reflectors or projection lenses, must be positioned or adjusted very precisely relative to each other, for example so as to avoid any blurred focus, false imaging, failure to reach the required light values and extraneous light. This is currently not required in vehicle headlamps according to prior art.

Furthermore, adjusting devices for assemblies often have a level of play in the adjusting connections for the optical components, which can unfavorably impair the optical properties of the headlamp.

The object of the invention is to overcome the mentioned disadvantages or satisfy the requirements better than prior art allows. In addition, the ability to compensate for component and assembly tolerances and set optical elements in a highly precise manner is to be created.

The object of the invention is achieved with a motor vehicle headlamp of the kind mentioned at the outset, in that the projection optics are secured in a frame movably arranged in the bracket, and a lever is further provided that is rotatably connected with the bracket by means of axis elements forming a pivot axis that runs transverse, preferably normal to the projection axis, and the frame has at least one lug lying between the bracket and lever, and the lever is set up to press against the at least one lug during a rotational motion around the pivot axis, thereby displacing the frame in the bracket along the projection axis.

As a result of the inventive array, the position of the at least one projection optics can be very finely set by the at least one lever. According to the law of the lever, a large path of the lever arm of the lever to which force is applied, which can be actuated with a slight exertion of force, can be transferred to a smaller path of the load arm, which can displace the position of the projection optics with a greater force.

A favorable configuration of the frame, which together with the at least one bracket provides a displaceable mounting of the at least one projection optics, and the inventive solution can achieve a highly precise setting or adjustment of assemblies in a vehicle headlamp, for example light sources, reflectors or lenses.

The inventive configuration of the vehicle headlamp further enables a very compact design.

In addition, the invention offers great advantages during assembly, since the vehicle headlamp need not be disassembled into its individual parts for adjusting the assemblies or the assemblies need not be successively put together so that they can be set relative to each other. After assembly is complete, an entire array can be adjusted. The extent of adjustment can be observed in the resulting light image of the headlamp.

In a further development of the invention, at least one flexible, elastic spring element is arranged between the at least one lug and the bracket. A flexible spring element makes it possible to apply a pretension to the adjusting connection, so that the adjusting connection can be set free of play. In addition, this creates a connection that can be fixed in any position, so that very individual and precise attention can be paid to the installation conditions. These installation conditions can be caused by tolerances in the geometry or assembly of individual assemblies, which are to be reduced or optimally compensated. This also makes it possible to consider the situation for installing the headlamp in a vehicle.

It is especially advantageous for at least one connecting element, preferably a screw, to further be arranged between the bracket and lever, which is set up to connect the bracket with the lever. This allows the connection to be finely adjustable.

It is beneficial for the light source to comprise at least one semiconductor light source, in particular an LED or a laser diode. For this reason, it is also beneficial for the projection optics to comprise at least one optical lens, as well as for a controllable reflector, in particular a DMD, to be arranged between the light source and projection optics.

In particular for controllable reflectors, the accuracy requirements placed on the entire optical array are particularly stringent, which is why the inventive array can very advantageously be used with a DMD, meaning a controllable reflector in DLP® technology.

It is especially advantageous for the bracket to comprise a guide arranged parallel to the projection axis, which is set up to receive the at least one lug of the frame and guide the at least one lug of the frame along the guide of the bracket. The guide improves the alignment of the projection optics during adjustment.

Selecting a suitable shape for the strap can enable a uniform, symmetrical force transmission.

In an advantageous embodiment of the invention, the lever is bent in the shape of a U, and has two ends, wherein the two ends of the U-shaped lever each have an opening to receive axis elements, through which the pivot axis of the lever runs, with the U-shaped lever further being provided with an opening to receive a connecting element, preferably an adjusting screw, with which the lever can be connected with the bracket. Several openings are also possible for receiving the respective connecting elements. The middle of the lever lies between the two ends of the lever.

The U-shaped lever is beneficial in particular in cases where the bracket and frame with the projection optics are to be displaceable and adjustable over a large path. A guide can be used by way of support for this purpose. The U-shaped lever is particularly well suited, since the lever can thereby have a large lever length, as it envelops the bracket and frame arrangement, and in the process does not cut the beam path of the light.

In another advantageous, alternative embodiment of the invention, the lever is ring-shaped, and has at least one opening to receive at least one axis element, through which the pivot axis runs, wherein the opening runs through the ring-shaped lever tangentially to its mean diameter. Furthermore, the ring-shaped lever is provided with an opening to receive a connecting element, preferably an adjusting screw, which can be used to connect the lever with the bracket. The ring-shaped lever preferably comprises at least one overlay set up to press on the at least one lug, and the frame forms a shared component with the at least one lug.

The ring-shaped lever is beneficial in particular in cases where the at least one bracket and the frame with the projection optics are to be displaceable and adjustable over a small path.

It is further advantageous for the ring-shaped lever to form a shared component with the lug, so as to simplify the structure.

It is further advantageous for an additional optical system to be provided, which has an optical axis, wherein the additional optical system is secured to the bracket, and the optical axis of the additional optical system preferably lies coaxially in the projection axis.

A further development of the invention provides that the motor vehicle headlamp comprise two projection optics with two projection axes and preferably two brackets for receiving the two projection optics. As a result, the optical parameters of the projection optics can be very flexibly adjusted. This is advantageous in particular in cases where one of the two projection optics lies within a housing, and the other of the two projection optics lies outside of the housing. As a result, incremental adjustments can be made based on progress during assembly. The second projection optics lying outside of the housing can then be adjusted to the circumstances during installation into a vehicle, while the first projection optics is no longer adjusted.

A further development of the invention can provide an additional projection optics in the form of an additional optical system, which is secured in the bracket. By adjusting the additional optical system relative to the projection optics, the optical parameters for the overall optics comprised of one or several projection optics and additional optical systems become especially easy to set.

It is here beneficial for the flexible adjustment and setting of optical parameters that the two projection axes run coaxially or parallel.

In a further development of the invention relating to the arrangement of optical elements, it is beneficial for the two projection axes of the two projection optics to have an angle relative to each other, wherein the angle preferably lies only in a horizontal plane in the installed position of the motor vehicle headlamp, and preferably measures between 0° and 10°.

A further development of the invention provides a motor vehicle that comprises at least one inventive motor vehicle headlamp. As a result, the inventive motor vehicle headlamp can be easily adapted and adjusted to the installation situation and position in a motor vehicle.

Figure 2:
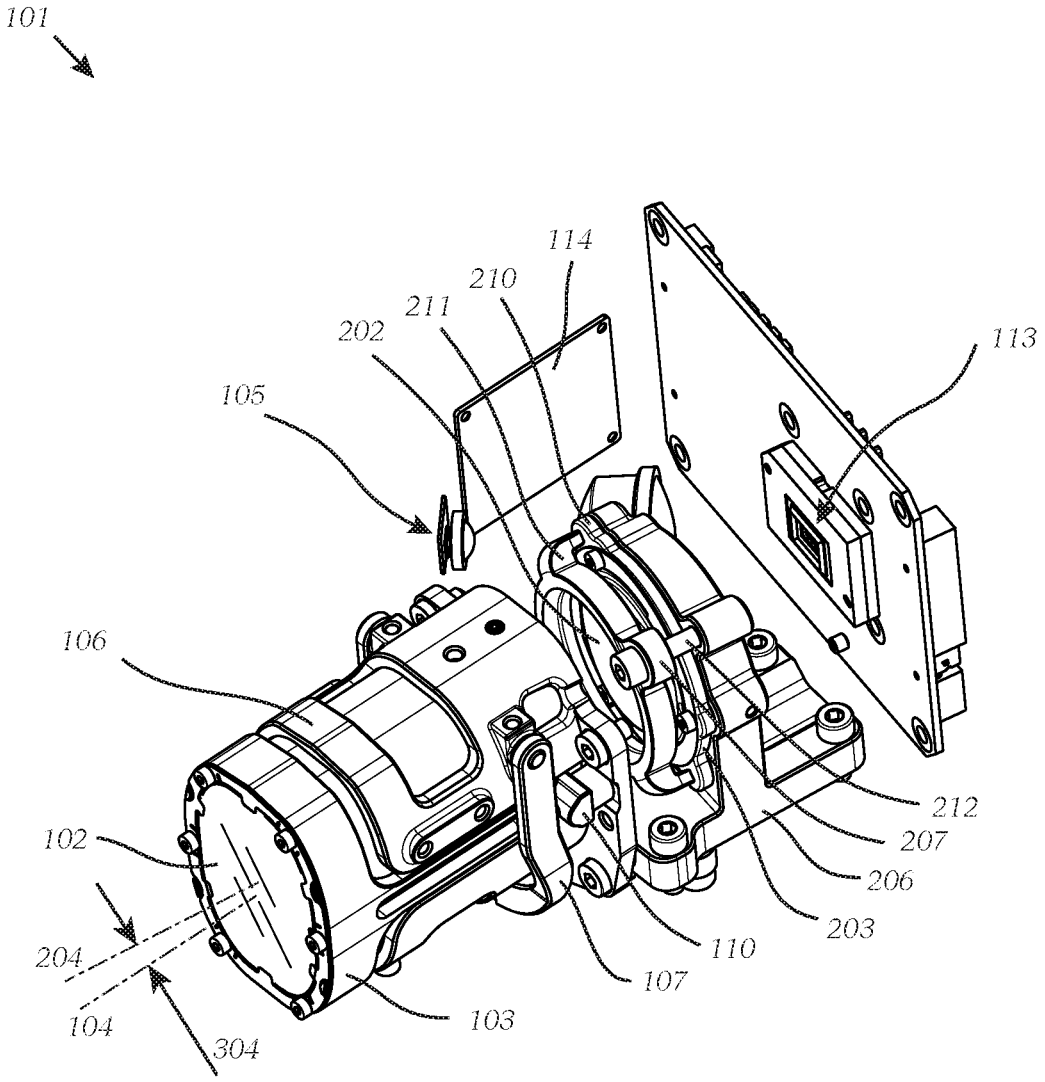
Figure 3:
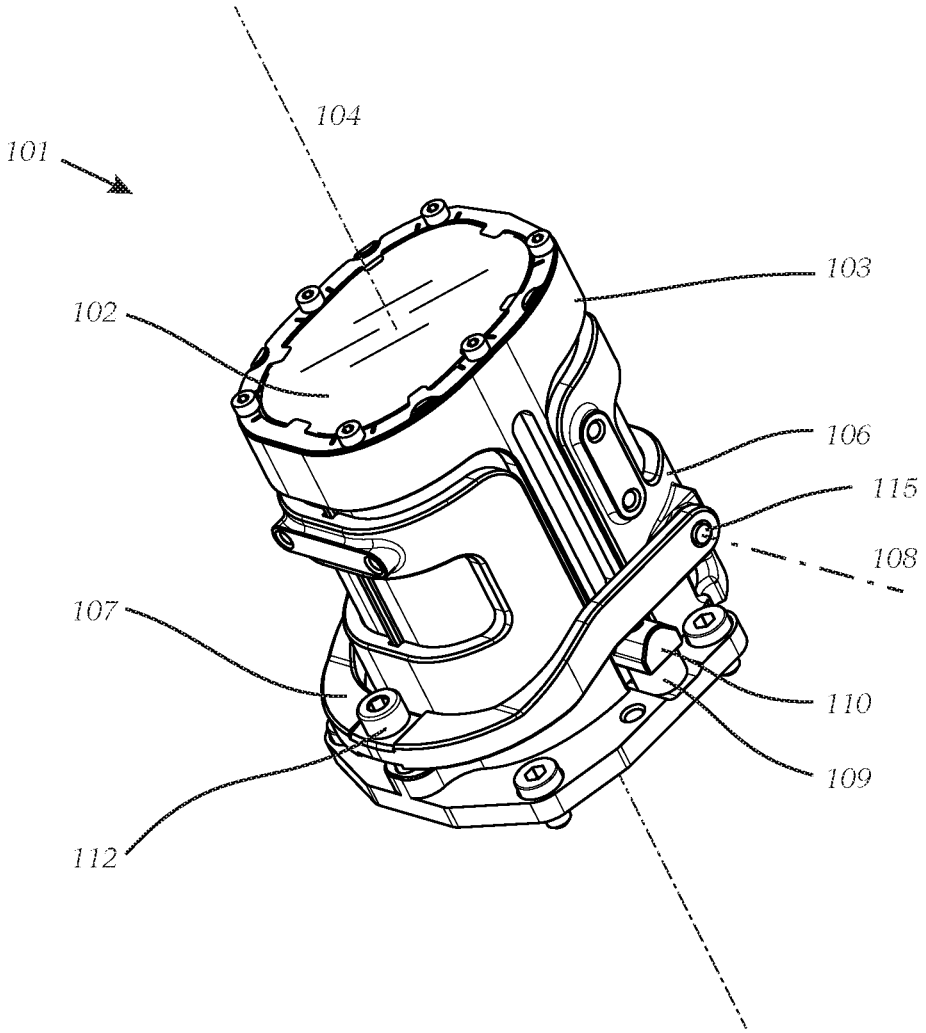
Figure 4:
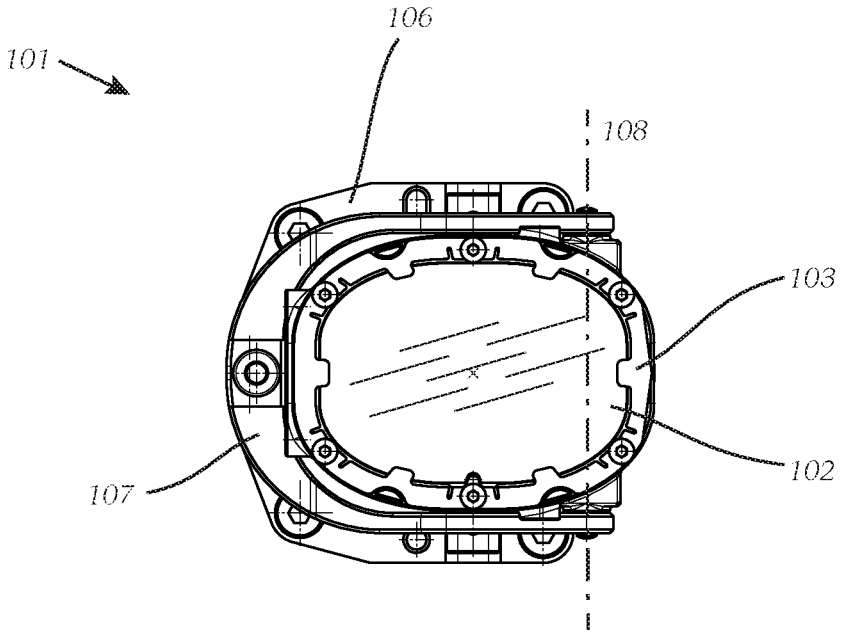
Figure 5:
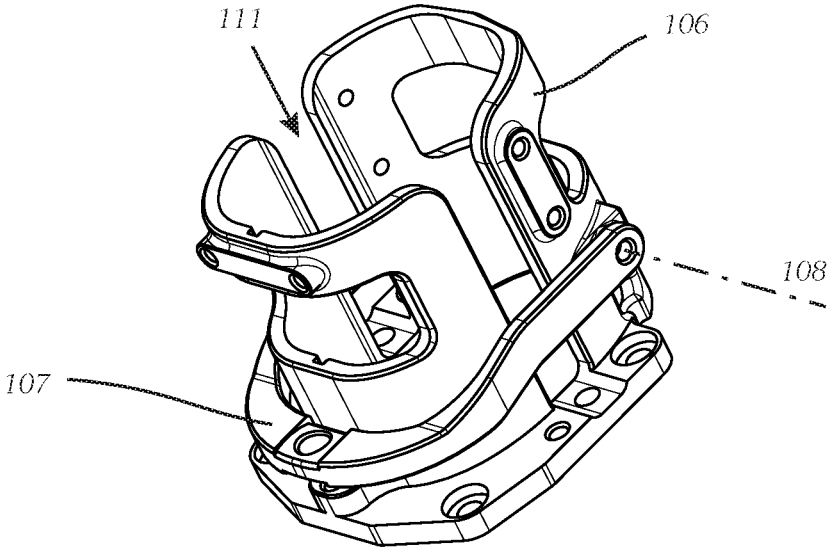
Figure 6:
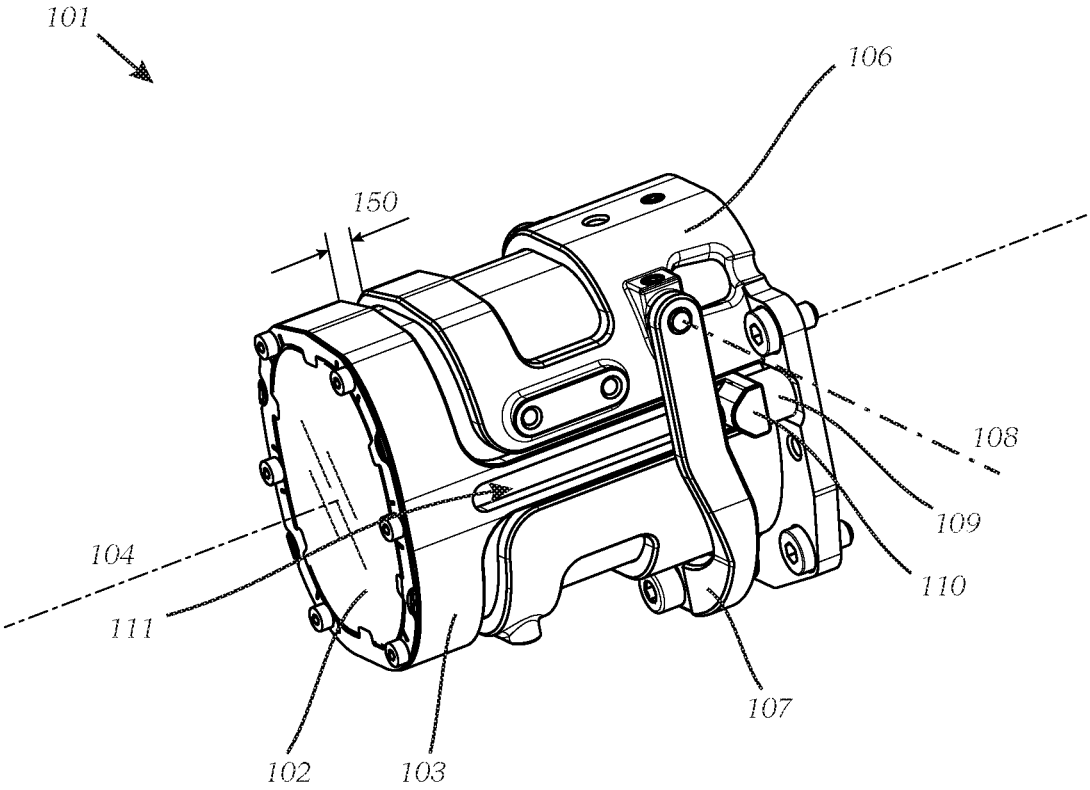
Figure 7:
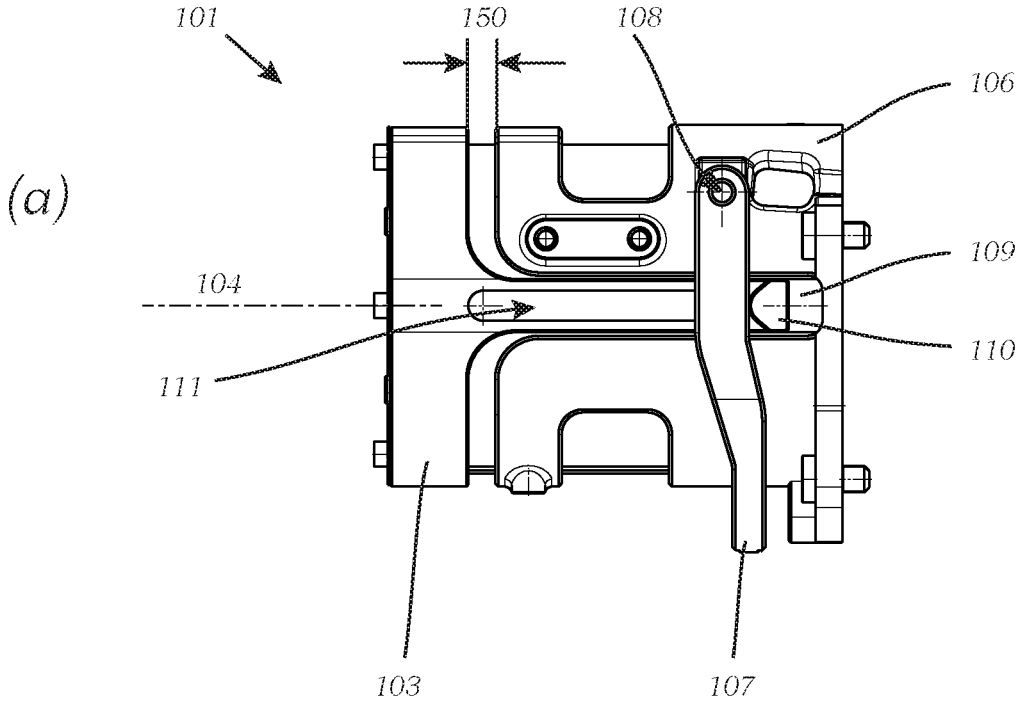
Figure 7:
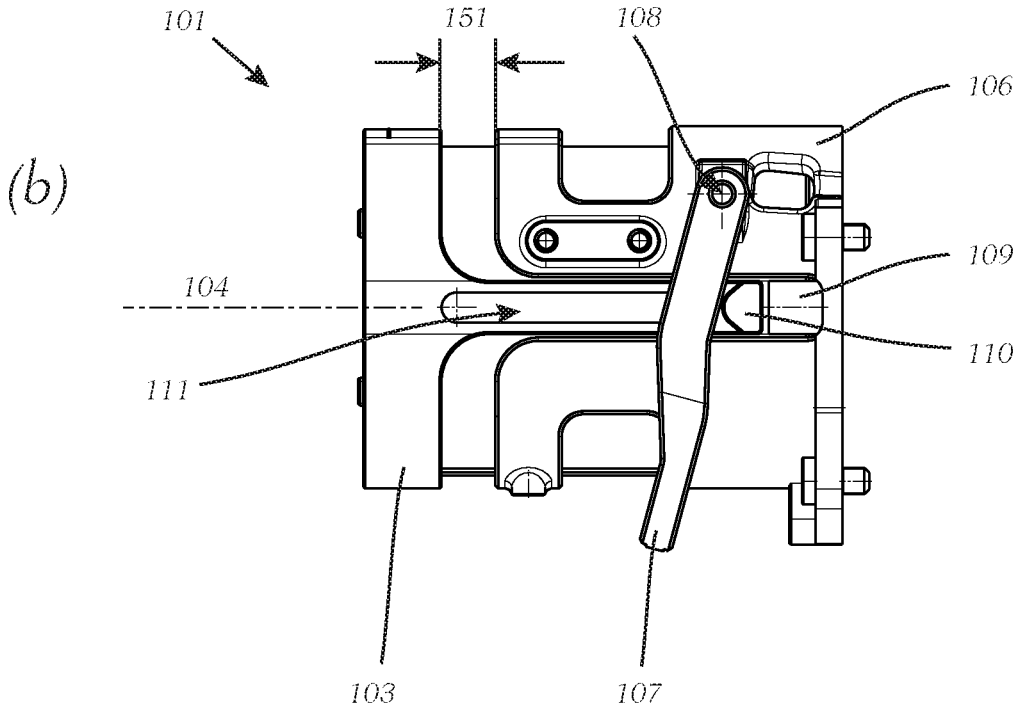
Figure 8:
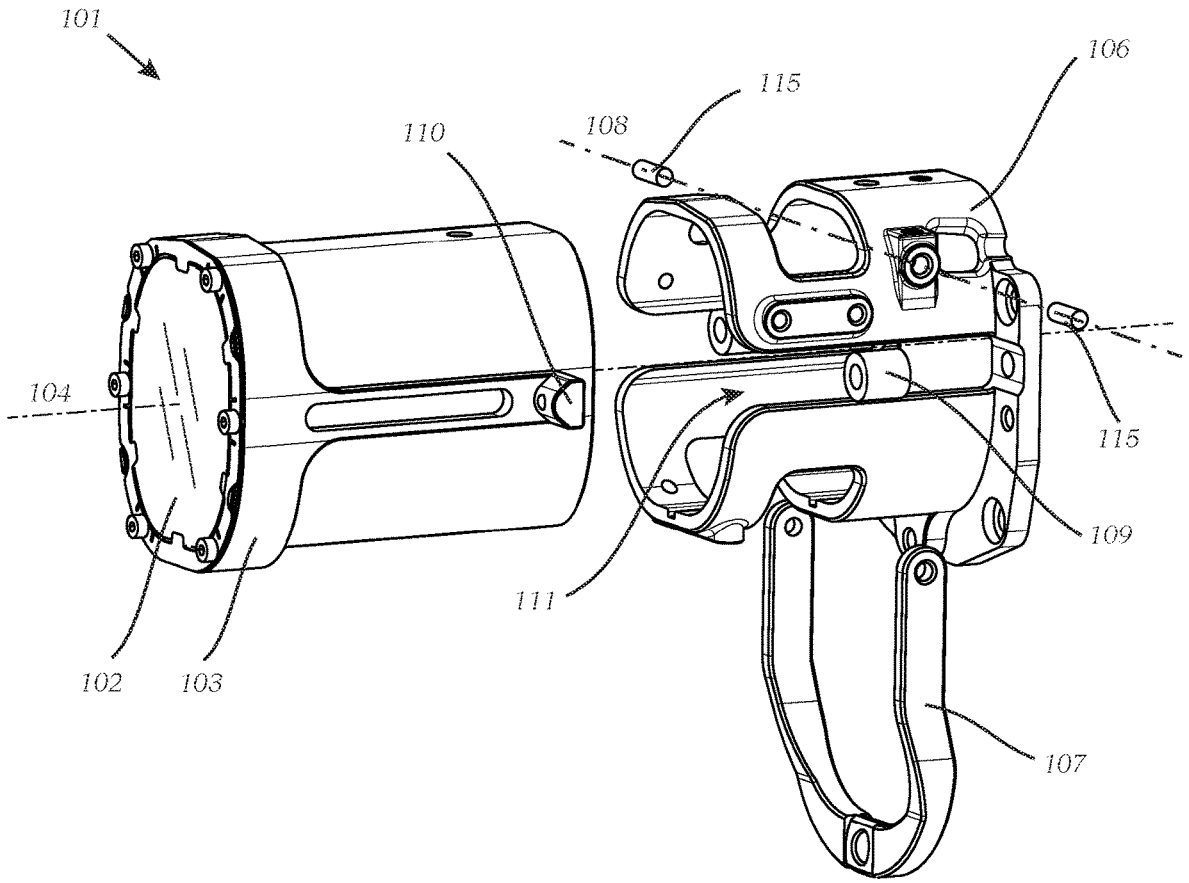
Figure 9:
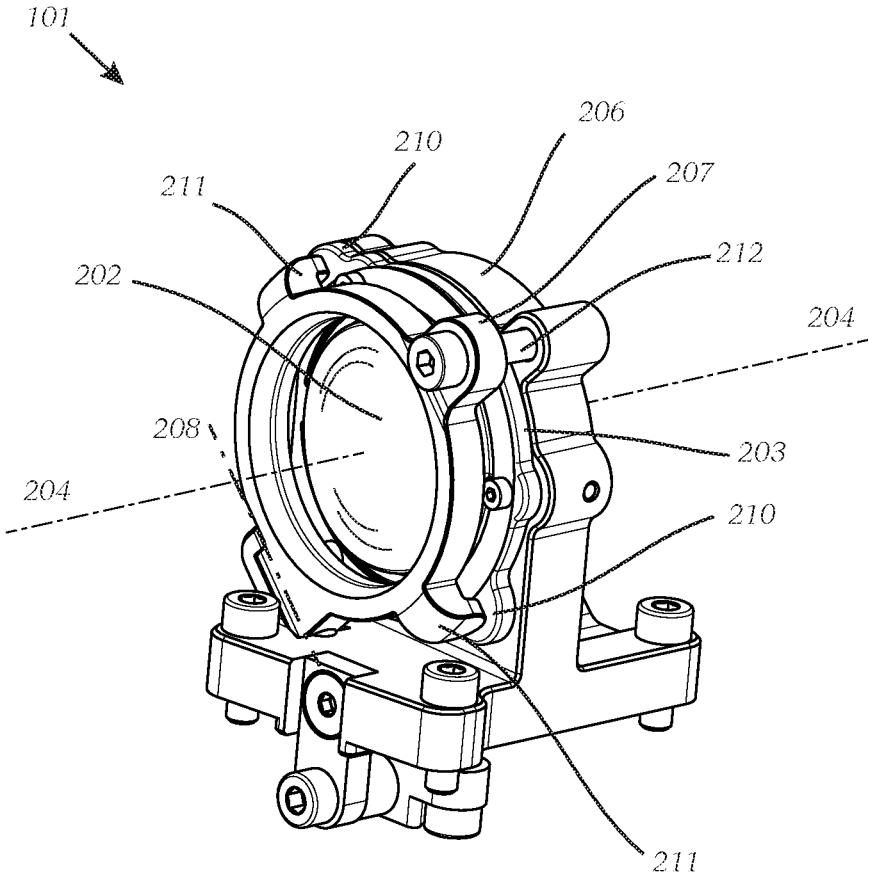
Figure 10:
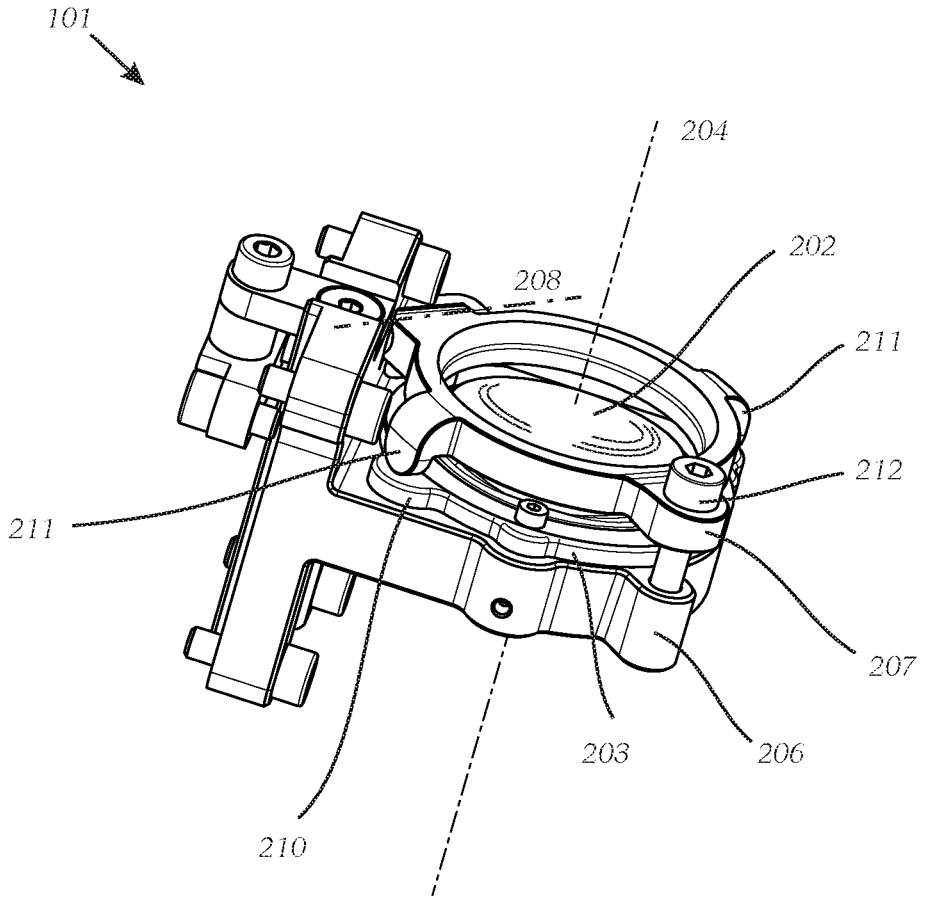
Figure 11:
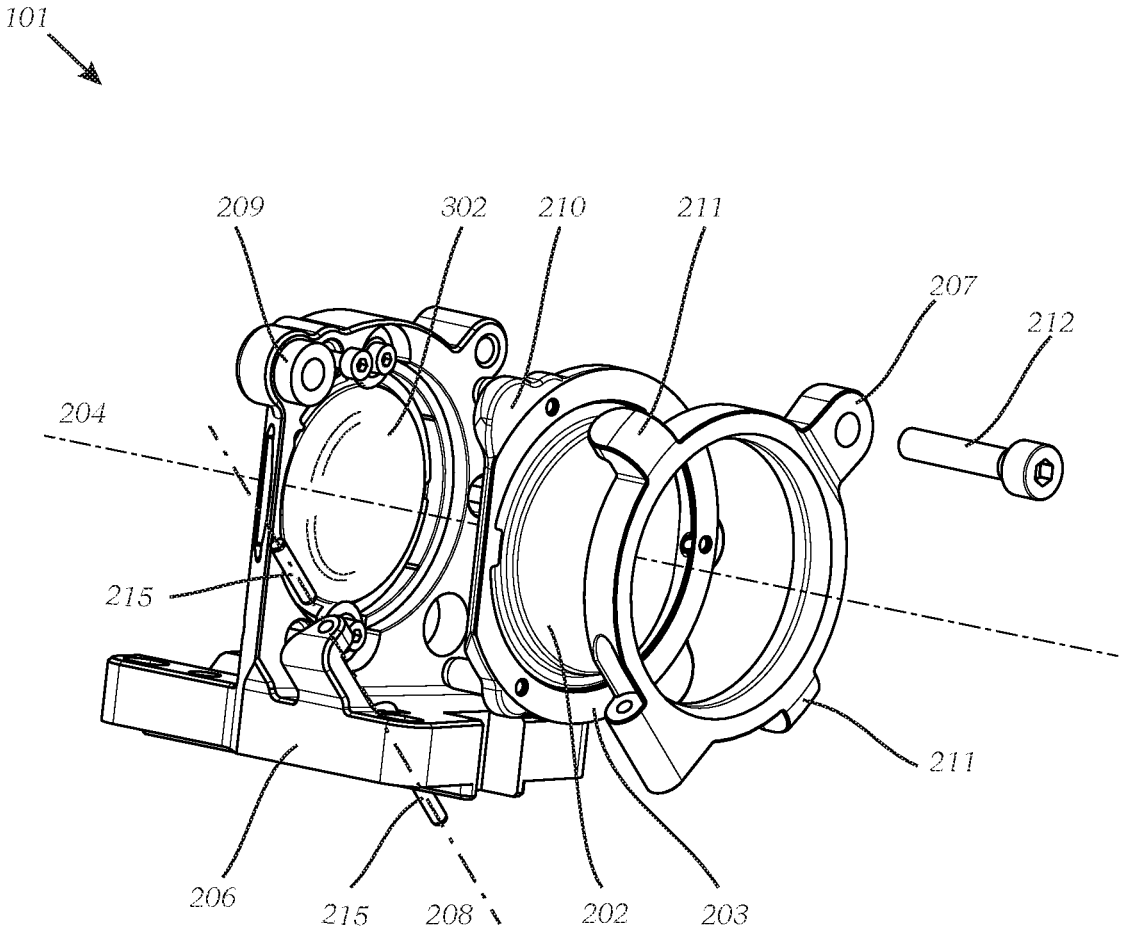

The invention and its advantages will be described in greater detail below based upon nonrestrictive exemplary embodiments, which are illustrated in the attached drawings. The drawings show:

FIG. 1 a perspective view of an embodiment of a motor vehicle headlamp according to the invention, FIG. 2 an exploded view of the motor vehicle headlamp according to FIG. 1, FIG. 3 a perspective view of a first adjusting device of the motor vehicle headlamp according to FIGS. 1 and 2, FIG. 4 a view from the front of the arrangement according to FIG. 3, FIG. 5 a perspective view of an arrangement of components of the motor vehicle headlamp according to FIG. 1, FIG. 6 another view of the arrangement according to FIG. 3, FIG. 7*a* a view of a first adjustment position of the arrangement according to FIG. 3, FIG. 7*b* a view of a second adjustment position of the arrangement according to FIG. 3, FIG. 8 an exploded view of the arrangement according to FIG. 3, FIG. 9 a perspective view of a second adjustment position of the motor vehicle headlamp according to FIGS. 1 and 2, FIG. 10 another view of the arrangement according to FIG. 9, FIG. 11 an exploded view of the arrangement according to FIG. 9.

Drawing reference to FIG. 1 to FIG. 11, an exemplary example of the invention will now be explained in more depth. Shown in particular for the invention are the important parts in a headlamp, wherein it is clear that a headlamp still contains many other parts that are not shown, which allow for a sensible use in a motor vehicle, for example in an automobile or motorcycle. For example, cooling devices for components, actuation electronics or other optical elements are thus not shown for the sake of clarity.

An installation position in a vehicle is not shown on a separate figure for an inventive headlamp according to the following description, since the installation position of the inventive headlamp is no different than for known prior art. The adjustability achieved by the inventive headlamp during installation in a vehicle is derived from the description of exemplary embodiments according to FIGS. 1 to 11.

Shown on FIGS. 1 and 2 is a motor vehicle headlamp, comprising a light source 105, a first projection optics 102 and a second projection optics 202 and a first bracket 106 and a second bracket 206, wherein the light source 105 is connected with the brackets 106 and 206 in a mechanically fixed manner. The light source 105 is further set up to emit by means of the projection optics 102 and 202 in the direction of a first projection axis 104, or a second projection axis 204. An angle 304 is here present between the projection axes 104 and 204. In this example, the angle 304 lies in a horizontal plane, proceeding from an installation position of the headlamp in a vehicle, and measures between 0° and 10°, depending on design. However, it may make sense in other exemplary embodiments for the two axes to be situated coaxially or provide an angle 304 in a spatial plane oriented as desired. Located between the light source 105 and projection optics 102 and 202 is an electronically controllable reflector 113 in the form of a micromirror array, for example a DLP® or DMD, which can reflect the light emitted by the light source 105 in the direction of the projection axes 104 or 204, depending on the actuation. Those mirrors of the controllable reflectors 113 actuated in such a way as to not reflect the light in the direction of the projection axis 104 can alternatively reflect the light in the direction of an absorber 114.

In this exemplary embodiment of the invention, use is made of two projection optics 102 and 202 with two projection axes 104, 204, wherein the two projection axes 104, 204 run coaxially. Further provided are additional components, such as the brackets 106, 206 to receive the two projection optics 102, 202, also twofold in varying configurations. However, just a single projection optics can be used in a motor vehicle headlamp, for example so as to realize the structure more compactly or cost-effectively. The embodiment shown is characterized by an especially flexible adjustability for the optical parameters of the projection optics or the overall projection optics comprised of the two projection optics. As is clear, two motor vehicle headlamps 101 can be installed during assembly in a motor vehicle.

The light source 105 is connected with a heat sink, so as to dissipate heat loss generated by the light source 105. The light source 105 can comprise one or several light-generating components, such as semiconductor light sources, in particular LED's or laser diodes, along with a primary optical system containing one or several optical lenses or apertures. It is also possible to include means for converting light from a first wavelength range to a second wavelength range, for example a conversion phosphorus.

The controllable reflector 113 is here mounted on a printed circuit board, which can comprise additional electronic components for actuating the controllable reflector 113 or mechanical elements.

The projection optics 102 and 202 each comprise at least one optical lens. Of course, the lens systems can also consist of an array of several lenses, or also include apertures that form projection optics 102 and 202.

The first projection optics 102 is secured in a frame 103 that is movably arranged in the bracket 106. Also provided is a lever 107. The frame 103 here has two lugs 110, which lie between the bracket 106 and lever 107.

The second projection optics 202 is fastened in a frame 203, which is movably arranged in the bracket 206. In addition, a lever 207 is enveloped by two pressing elements 211. The frame 203 here has lugs 210 that lie between the bracket 206 and the pressing elements 211 of the lever 207. Arranged between the lug 210 and bracket 206 is a respective flexible, elastic spring element 209. The frame 203 is fastened to the bracket 206 with a connecting element 212.

FIG. 3 shows a cutout of the motor vehicle headlamp 101 with elements for setting the first projection optics 102, which is fastened in the frame 103 and movably arranged in the bracket 106. Further provided is the lever 107, which is rotatably connected with the bracket 106 by means of axis elements 115 forming a pivot axis 108 that runs transverse or normal to the projection axis 104. The frame 103 has two lugs 110 (only one lug is visible on the figure), which lie between the bracket 106 and lever 107. The lugs 110 are part of the frame 103. The lever 107 is set up to press against the two lugs 110 during a rotational motion around the pivot axis 108, thereby displacing the frame 103 in the bracket 106 along the projection axis 104.

Also arranged between the bracket 106 and lever 107 is a connecting element 112, which is set up to connect the bracket 106 with the lever 107. The connecting element 112 is preferably a screw, which can be tightened to align the frame with the bracket 106, so as to displace the projection optics 102 along the projection axis 104 and thereby optically adjust it.

The bracket 106 comprises a guide 111 arranged parallel to the projection axis 104, which is set up to receive the lugs 110 of the frame 103 and guide the lugs 110 of the frame 103 along the guide 111 of the bracket 106.

Arranged between the lug 110 and bracket 106 is a flexible, elastic spring element 109, against which the lug 110 can press during exposure to a force applied by the lever 107.

The lever 107 is shaped like a U, and has two ends. The two ends of the U-shaped lever 107 each have an opening, into which the axis elements 115 can be inserted and the pivot axis 108 of the lever 107 runs. The U-shaped lever 107 is further provided with an opening to receive the connecting element 112, preferably an adjusting screw, with which the lever 107 can be connected with the bracket 106.

FIG. 4 presents a front view of the projection optics 102 of the headlamp 101, which is fastened in the frame 103 arranged in the bracket 106. The lever 107 and its pivot axis 108 are visible.

FIG. 5 shows the bracket 106 with the lever 107 and its pivot axis 108. The guide 11 formed by elements of the bracket 107 is discernible. It is clear that each lug 110 lies in an accompanying guide 111.

FIG. 6 shows the arrangement according to FIG. 3 as viewed in perspective from below. Visible in addition to the description for FIG. 3 is an adjustment distance 150, which can be used to adjust the projection optics 102 relative to the bracket. The adjustment takes place by displacing the projection optics 102 along the projection axis 104, wherein the lugs 110 are displaced into the respective guides 111.

FIGS. 7*a* and 7*b* depict the adjustment of the arrangement of the headlamp 101, wherein the displacement of the projection optics 102 can be discerned. The U-shaped lever 107 has two ends, which each have openings through which the pivot axis 108 runs and around which the lever 107 can be pivoted. Located between the two ends of the lever is the middle of the lever, which has an additional opening to receive the connecting element 112.

Visible on FIG. 7*a* is a first adjustment position of the arrangement of the headlamp 101, in which the middle of the lever of the U-shaped lever 107 abuts tightly against the bracket 106. The lug 110 lying in the guide 111 along the projection axis 104 here presses against the spring element 109. The frame 103 connected with the lug 110 has a first adjustment distance 150 to the bracket 106.

FIG. 7*b* shows a second adjustment position of the arrangement of the headlamp 101, in which the middle of the lever of the U-shaped lever 107 has a larger distance, a second adjustment distance, from the bracket 106 than in the first adjustment position.

FIG. 8 presents an exploded view of the arrangement of the headlamp 101 for the first projection optics 102. The projection optics 102, the frame 103, the lug 110 and the projection axis 104 are visible. Further depicted is the bracket 106, the lever 107, two axis elements 115, the pivot axis 108, as well as the spring element 109 and the guide 111.

FIG. 9 shows the second projection optics 202 of the headlamp 101.

The projection optics 202 is fastened in a frame 203, which is movably arranged in the bracket 206. In addition, a lever 207 is enveloped by two pressing elements 211, and rotatably connected with the bracket 206 by means of axis elements 215 forming a pivot axis 208 that runs transverse or normal to the projection axis 204. The frame 203 has two lugs 210, which lie between the bracket 106 and lever 107. The lugs 210 are part of the frame 203. The lever 207 is set up to press against the lugs 210 with the pressing elements 211 during a rotational motion around the pivot axis 208, thereby displacing the frame 203 in the bracket 206 along the projection axis 204. In this embodiment, the lever 207 and pressing elements 211 form a shared component, so that the lever 207 can transmit an acting force directly to the lugs 210. Respective flexible, elastic spring elements 209 are arranged between the lugs 210 and bracket 206. The lever 207 is adjustably connected with the bracket 206 via the connecting element 212.

The lever 207 is ring-shaped, and has openings to receive axis elements 215, through which the pivot axis 208 runs, wherein the openings run through the ring-shaped lever 207 tangentially to its mean diameter. A middle of the lever lies in the region opposite the one through which the pivot axis 208 runs. The ring-shaped lever 207, preferably the middle of the lever, is provided with an opening to receive the connecting element 212, preferably an adjusting screw, with which the lever 207 can be adjustably connected with the bracket 206, and the ring-shaped lever 207 forms a shared component with the pressing elements 211. A thread in the form of a screw is provided in the bracket 206 to receive the connecting element 212.

FIG. 10 presents another perspective view of the projection optics 202 of the headlamp 101 with its projection axis 204, which is fastened in the frame 203 arranged in the bracket 206. The lever 20 with its pivot axis 208 and pressing elements 211 is visible, as are the two lugs 210 of the frame 203.

Also arranged between the bracket 206 and lever 207 is a connecting element 212, which is set up to adjustably or fixedly connect the bracket 206 with the lever 207.

FIG. 11 presents an exploded view of the arrangement on FIG. 10, wherein in particular the axis elements 215 are visible, along with a spring element 209.

Further visible is an additional optical system 302, which has an optical axis, and the additional optical system 302 is arranged on and secured to the bracket 206. The optical axis of the additional optical system 302 preferably lies coaxially in the projection axis 204. By adjusting the projection optics 202 relative to the additional optical system 302, the optical parameters for the overall optics consisting of the projection optics 102 and 202 as well as the additional optical system 302 can be very easily and flexibly set.

REFERENCE LIST

101 Motor vehicle headlamp
102, 202 Projection optics
103, 203 Frame
104, 204 Projection axis
105 Light source
106, 206 Bracket
107, 207 Lever
108, 208 Pivot axis
109, 209 Spring element
110, 210 Lug
111 Guide
211 Pressing element
112, 212 Connecting element
113 Reflector
114 Absorber
115, 215 Axis element
150, 151 Adjustment distance
302 Additional optical system
304 Angle

The invention claimed is:

1. A motor vehicle headlamp (101), comprising:
a light source (105);
projection optics (102, 202); and
a bracket (106, 206), wherein the light source (105) is connected with the bracket (106, 206) and configured to project light in the direction of a projection axis (104, 204) by means of the projection optics (102, 202),
wherein the projection optics (102, 202) are secured in a frame (103, 203) movably arranged in the bracket (106, 206), and a lever (107, 207) is further provided that is rotatably connected with the bracket (106, 206) by means of axis elements (115, 215) forming a pivot axis (108, 208) that runs transverse or normal to the projection axis (104, 204), and the frame (103, 203) has at least one lug (110, 210) lying between the bracket (106, 206) and lever (107, 207), and the lever (107, 207) is configured to press against the at least one lug (110, 210) during a rotational motion around the pivot axis (108, 208), thereby displacing the frame (103, 203) in the bracket (106, 206) along the projection axis (104, 204).

2. The motor vehicle headlamp (101) according to claim 1, wherein at least one flexible, elastic spring element (109, 209) is arranged between the at least one lug (110, 210) and the bracket (106, 206).

3. The motor vehicle headlamp (101) according to claim 1, wherein at least one connecting element (112, 212) is further arranged between the bracket (106, 206) and lever (107, 207), which is configured to connect the bracket (106, 206) with the lever (107, 207).

4. The motor vehicle headlamp (101) according to claim 1, wherein the light source (105) comprises at least one semiconductor light source.

5. The motor vehicle headlamp (101) according to claim 1, wherein the projection optics (102, 202) comprises at least one optical lens.

6. The motor vehicle headlamp (101) according to claim 1, wherein a controllable reflector is arranged between the light source (105) and the projection optics (102, 202).

7. The motor vehicle headlamp (101) according to claim 1, wherein the bracket (106) comprises at least one guide (111) arranged parallel to the projection axis (104), which is configured to receive the at least one lug (110) of the frame (103) and guide the at least one lug (110) of the frame (103) along the at least one guide (111) of the bracket (106).

8. The motor vehicle headlamp (101) according to claim 1, wherein the lever (107) is bent in the shape of a U, and has two ends, which each have openings into which respective axis elements (115) can be placed, through which the pivot axis (108) of the lever (107) runs, with the U-shaped lever (107) further being provided with an opening to receive a connecting element (112) with which the lever (107) can be connected with the bracket (106).

9. The motor vehicle headlamp (101) according to claim 1, wherein:

the lever (207) is ring-shaped and has at least one opening to receive at least one axis element (215), through which the pivot axis (208) runs, the opening runs through the ring-shaped lever (207) tangentially to its mean diameter, the ring-shaped lever (207) is further provided with at least one opening to receive a connecting element (212), which can be used to connect the lever (207) with the bracket (206), the ring-shaped lever (207) comprises at least one pressing element (211), which is configured to press on the at least one lug (210), and the frame (203) forms a shared component with the at least one lug (210).

10. The motor vehicle headlamp (101) according to claim 1, wherein an additional optical system (302) is provided, which has an optical axis, wherein the additional optical system (302) is secured to the bracket (106, 206), and the optical axis of the additional optical system (302) lies coaxially in the projection axis (104, 204).

11. The motor vehicle headlamp (101) of claim 1, comprising two of the projection optics (102, 202) with two projection axes (104, 204) and two brackets (106, 206) for receiving the two projection optics (102, 202).

12. The motor vehicle headlamp (101) according to claim 11, wherein the two projection axes (104, 204) of the two projection optics (102, 202) run coaxially or parallel.

13. The motor vehicle headlamp (101) according to claim 11, wherein the two projection axes (104, 204) of the two projection optics (102, 202) have an angle (304) relative to each other, wherein the angle (304) lies only in a horizontal plane in the installed position of the motor vehicle headlamp (101), and measures between 0° and 10°.

14. A motor vehicle comprising at least one motor vehicle headlamp (101) according to claim 1.

15. The motor vehicle headlamp (101) according to claim 4, wherein the at least one semiconductor light source comprises an LED or a laser diode.

16. The motor vehicle headlamp (101) according to claim 6, wherein the controllable reflector is a digital micromirror device (DMD).

17. The motor vehicle headlamp (101) according to claim 8, wherein the connecting element (112) comprises an adjusting screw.

* * * * *